United States Patent [19]

Finnegan

[11] Patent Number: 4,944,147

[45] Date of Patent: Jul. 31, 1990

[54] APPARATUS FOR FORMING HORSE SHOES

[76] Inventor: Patrick J. Finnegan, 9 Parsonage Close, Kircubbin, County Down BT22 2 RZ, Ireland

[21] Appl. No.: 259,569

[22] PCT Filed: Dec. 8, 1986

[86] PCT No.: PCT/GB86/00745

§ 371 Date: Oct. 11, 1988

§ 102(e) Date: Oct. 11, 1988

[87] PCT Pub. No.: WO88/04208

PCT Pub. Date: Jun. 16, 1988

[51] Int. Cl.[5] ..... B21K 15/02

[52] U.S. Cl. ..... 59/56; 59/49; 59/50; 59/61

[58] Field of Search ..... 59/27, 39, 49, 40, 50, 59/57, 61, 37; 72/389, 212, 213

[56] References Cited

U.S. PATENT DOCUMENTS

| | | | |
|---|---|---|---|
| 498,838 | 6/1893 | Billings | 59/50 |
| 572,870 | 12/1896 | Crow | 59/56 |
| 953,759 | 4/1910 | Pedersen | 59/37 |
| 1,420,518 | 6/1922 | Boone et al. | 59/56 |
| 3,400,532 | 10/1965 | Smith | 59/36 |
| 3,500,679 | 3/1970 | Smith | 72/212 |
| 3,797,228 | 3/1974 | Kirkpatrick | 59/37 |

FOREIGN PATENT DOCUMENTS

| | | | |
|---|---|---|---|
| 321430 | 5/1902 | France | 59/37 |
| 28165 | 8/1917 | Norway | 59/40 |

*Primary Examiner*—David Jones

*Attorney, Agent, or Firm*—Armstrong, Nikaido, Marmelstein, Kubovcik & Murray

[57] ABSTRACT

Apparatus for forming horse shoes comprises a hydraulic press (10) with means to operate said press. A horse shoe former (12) is securable to the outer end of the cylinder of the ram and cylinder (11) of the press (10). The former (12) has two similarly shaped plates (13) secured, in mirror-image fashion, to the outer end of the cylinder of the ram and cylinder (11) of the press (10). The plates (13) have forming peripheries (13A) which are angled and engage a complementary shape formed of angled surfaces of two bottom face-to-bottom face blanks (22). An anvil (14) is located under the former (12) and against which the blanks (22) are deformed into substantial U-shapes by extension of the ram. Length-extendable means in the form of ram and cylinder arrangements (23, 24) are provided on opposite lateral sides of the anvil (14) and, on extension, cause the outer ends of the deformed blanks to be bent around said former plates (13).

7 Claims, 3 Drawing Sheets

APPARATUS FOR FORMING HORSE SHOES

This invention relates to apparatus for forming horse shoes. By tradition, horse shoes have been made individually by blacksmiths with each set comprising front and back pairs of shoes with a left and a right in each pair, and with or without raised heels. However, with the almost total demise of the blacksmith, horse shoes have been made mechanically from blanks which are lengths of straight iron bar: and fullered horse shoe iron bar is generally available for such manufacture. Fullered horse shoe iron bar has in cross-section four sides, that is major top and bottom faces, a front or outer face which is slightly rearwardly angled and a back or inner face which is sloped forwardly from bottom to top. A groove is provided lengthwise of the top face. As an expediency in such mechanical manufacture, it has not heretofore been possible to provide left and right shoes with raised heels, the ends of the shoes simply being feathered, or left for a farrier to form a raised heel prior to fitting shoes to a horse's hooves.

It is an object of the present invention to provide an apparatus capable of manufacturing left and right horse shoes and with or without raised heels.

In accordance with the present invention, apparatus for forming horse shoes comprises a hydraulic press, means to operate said press, a horse shoe former securable to the outer end of the ram or cylinder of the press, the former to engage, in use, with at least one blank of a length of elongate metal to be formed into a horse shoe, an anvil against which the or each blank is deformed into a substantial U-shape by extension of said ram, and means on each side of, and on movement towards, said anvil to cause the outer ends of the or each deformed blank to be bent around said former.

Preferably, the blank is of fullered horse shoe iron bar and the former has at least one plate with an angled periphery over its forming peripheral surface to complementarily engage the sloped face on a respective blank so to locate and correctly position said blank relative thereto and to the anvil.

Preferably also, the former comprises two similar shaped plates each having an angled periphery over their forming peripheral surface, the plates being arranged together in mirror-image fashion to form a V-shape in cross-section between the angled peripheries thereof to engage an inverted V-shape formed by the sloped back faces of two blanks arranged bottom face-to-bottom face, thereby to form in one operation a left and a right hand horse shoe.

Preferably further, the means on each side of the anvil comprises a ram and cylinder, the rams and cylinders being symmetrically arranged about the anvil with the rams at their distal ends adapted to abut the outer ends of the or each deformed blank around the former.

An embodiment of the present invention will now be described, by way of example, with reference to the accompanying diagrammatic drawings, in which.

Figure 4:
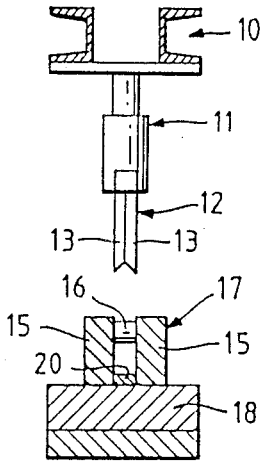
FIG. 4 is a cross-sectional view on the line IV—IV of FIG. 1.
Figure 5:
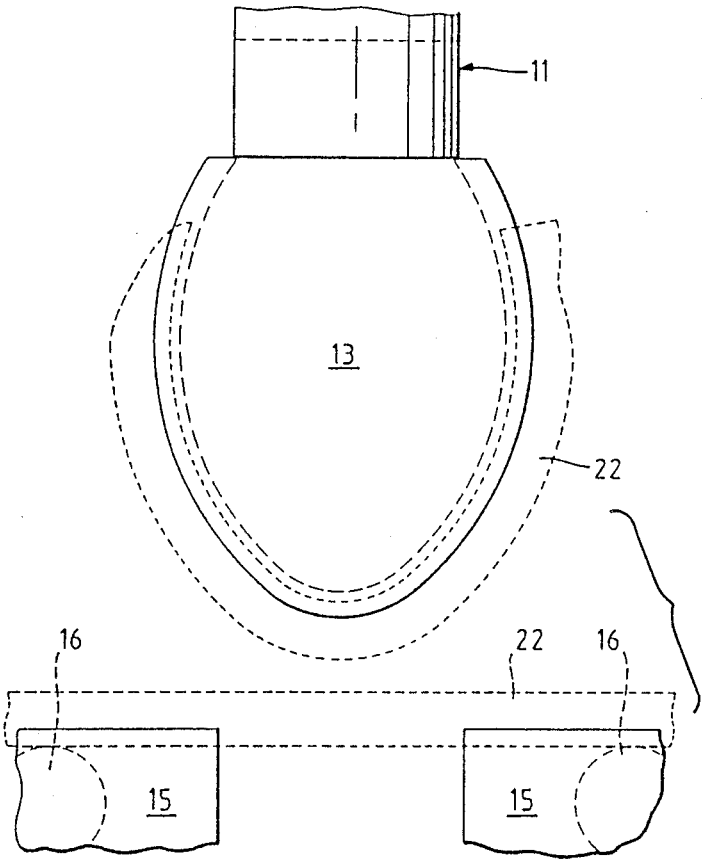
FIG. 5 is a detailed front view of a former and the top part of an anvil of the apparatus to a larger scale, and showing in broken line both a blank located on the anvil, and a formed horse shoe around a retracted former.
Figure 6:
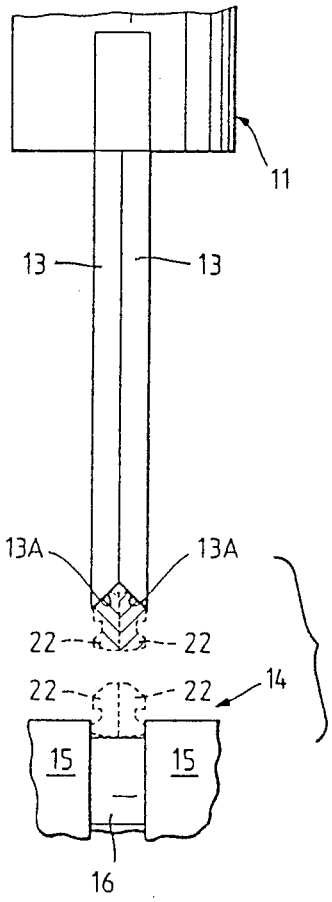
FIG. 6 is a side elevational view of the view shown in FIG. 5.

Referring to the drawings, apparatus for forming horse shoes comprises a hydraulic press 10 having a ram and cylinder 11 as shown and means to operate said press (not shown). The means to operate said press 10 comprises a hydraulic power pack comprising a hydraulic pump and hydraulic fluid supply reservoir with accompanying connecting hose, the pack operating in a conventional manner. The distal end of the ram is secured to a cross-beam ( FIG. 4 ) between two similar on-side rectangular frameworks of the press 10 and a horse shoe former 12 is securable to a mounting at the outer end of the cylinder. The former 12 comprises two similarly shaped plates 13 each of which has an angled periphery 13A over its forming peripheral surface. The plates 13 are bolted (not shown) in mirror-image together whereby a V-shape in cross-section is formed between the angled peripheries 13A of the bolted plates 13 as shown in FIGS. 4, 5 and 6. Below the ram and cylinder 11, an anvil 14 is provided formed of two parts 17, each comprising two cheeks 15 spaced apart the width of the former 12 and between them carrying a low friction rotatable roller 16. The rollers 16 are symmetrically mounted about a vertical mid-way line of the distance between the parts 17. Each part 17 is longitudinally spaced apart by a distance determined by the breadth of the plates 13 as herein after described. The parts 17 are carried by a block 18 and are in sliding engagement thereon whereby said distance between the parts 17 can be varied by adjusting the setting of two length-adjustable screws 19 s shown, one screw 19 being located on each lateral side of said block 18, and by locating a limit block 20 between said parts as shown. Different lengths of limit blocks 20 can be provided for use one at a time to suit different breadths of formers. The limit block bears against the inner lateral sides of the parts 17 nd the screws 19 bear one on each of the outer lateral sides of the parts to make fast said parts 17 in their selected position. The adjustment is required to accommodate formers of different breadths, determined by size and shape of shoes required.

Figure 1:
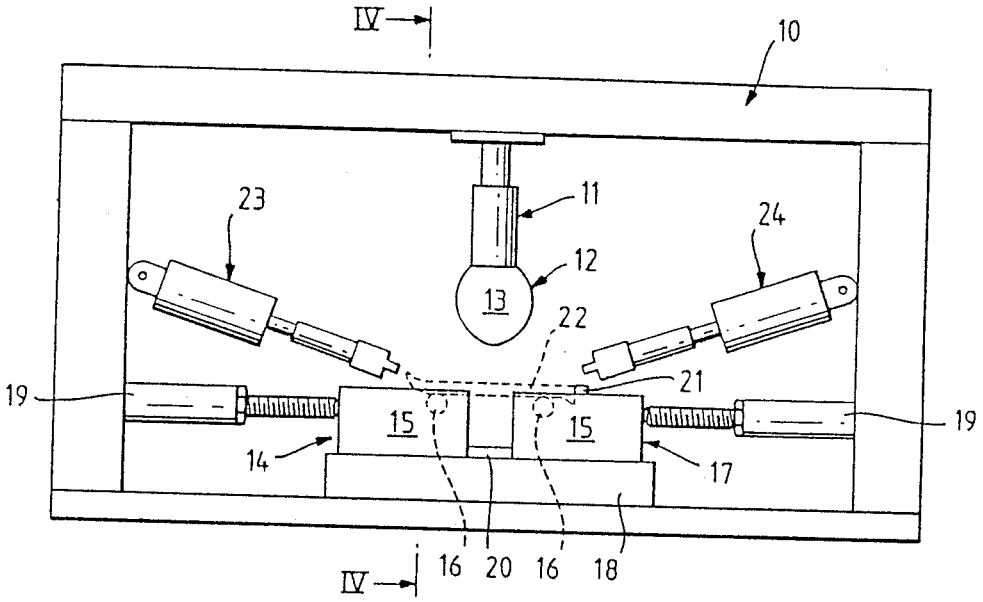
FIGS. 1, 2 and 3 are respectively front elevations of apparatus for forming horse shoes according to the present invention showing three stages in the formation of a horse shoe.
Figure 2:
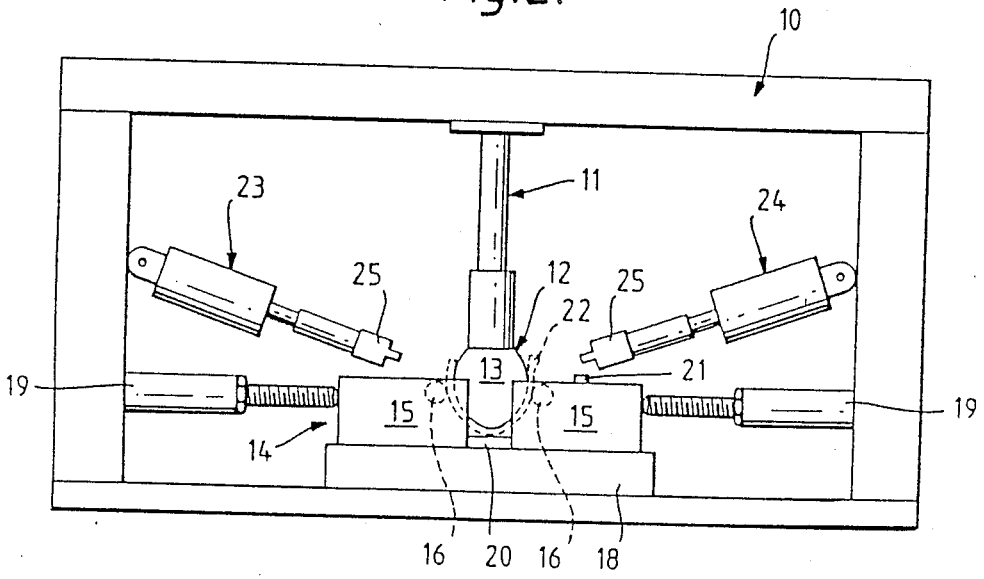
Figure 3:
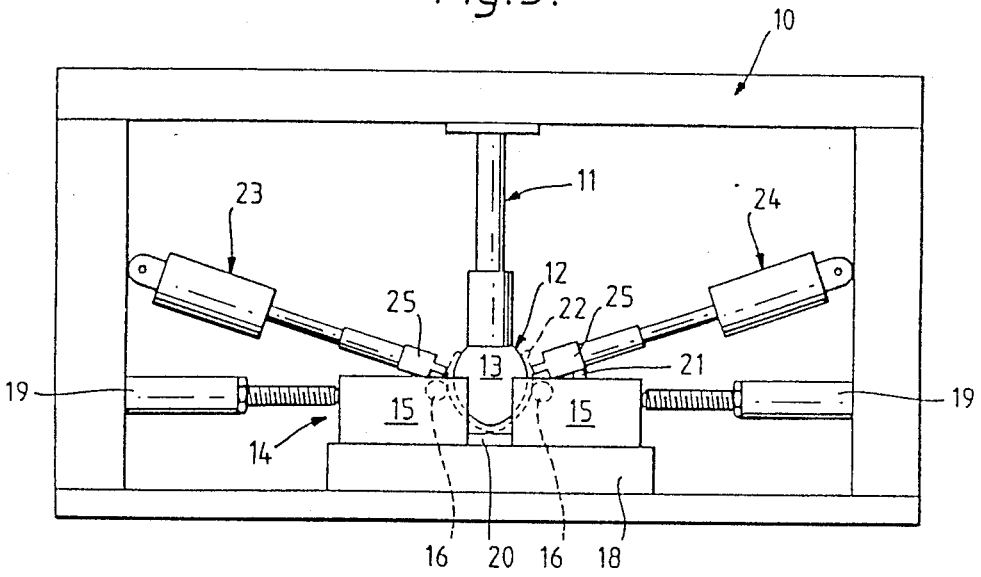

A stop 21 is provided on one part of the anvil to position two blanks 22, i.e. determined lengths of fullered horse shoe iron bar, arranged bottom face-to-bottom face as shown in broken line in FIG. 1. On extension of the ram from the cylinder, the former moves downward to engage the blanks 22, the sloped faces of the fullered horse shoe iron bar complementarily being engaged by the former's V-grooved peripheries 13A as shown in FIGS. 5 and 6, and cold form them into U-shapes as shown in FIG. 2. Means to cause the outer ends of the blanks to be bent around said former 12 are provided one on each lateral side of the anvil 14. The means each comprise a cylinder and piston arrangement. The arrangements 23, 24 each has a head 25 carried at the distal end of its respective piston to engage the outer ends of the limbs of the U-shape deformed shoes and bend them around the former 12 as shown in FIG. 3. The extent of movement of former 12 is limited by abutment of the blanks 22 against the limit block 20. The spacing of the parts 17 is determined as hereinbefore stated by the breadth of the former to be used and additionally by the breadth of the deformed blanks around said former 12. After the shoes have been formed, the pistons of arrangements 23, 24 and ram of ram and cylinder 11 are retracted, and plates 13 are unbolted to release the formed shoes. The plates are bolted together again ready for re-use. The ends of the blanks are already formed before the blanks are placed on the anvil, for example as shown in FIGS. 1, 2, 3 and 5, i.e. with the left hand side being feathered and the end at the right hand side being provided with a raised heel. Nail holes (not shown) are punched through the iron bar from the bottom or web of the groove for use in nailing the shoe, bottom face innermost, onto a horse's hoof. The holes can be punched out after the shoe is formed , however they are preferably punched into the blank before deforming.

After the shoe is formed, one or two clips (not shown) are formed, if required, by using a punching tool to punch out part of the front face of the shoe to create a bump which can then be formed into a tongue extending normally beyond the bottom face in a direction opposite to the top face.

Without departing from the scope of the invention, the former may comprise a bank of two or more pairs of plates 13, the other components of the apparatus being suitably altered to accommodate said bank and to enable the apparatus to operate.

I claim:

1. Apparatus for forming horse shoes comprising a hydraulic press having a ram and a cylinder, means to operate said press, a horse shoe former securable to the outer end of the ram or cylinder of the press, the former to engage, in use, with at least one blank of fullered horse shoe iron bar, an anvil against which the, or each, blank is deformed into a substantial U-shape by extension of said ram, and means on each side of, and on movement towards, said anvil to cause the outer ends of the, or each, deformed blank to be bent around said former, the former having at least one plate with an angled periphery over its forming peripheral surface to engage a sloped face of a respective blank to locate and correctly position said blank relative thereto and to the anvil.

2. Apparatus according to claim 1, wherein the former comprises two similar shaped plates each having an angled periphery over its forming peripheral surface, the plates being arranged together in mirror-image fashion to form a V-shape in cross-section between the angled peripheries thereof to engage an inverted V-shape formed by the sloped back faces of two blanks arranged bottom face-to-bottom face, thereby to form in one operation a left and a right horse shoe.

3. Apparatus according to claim 1 or 2, wherein the means on each side of the anvil comprises a ram and cylinder arrangement, the arrangements being symmetrically arranged about the anvil with the rams at their distal ends adapted to abut the outer ends of the or each deformed blank around the former.

4. Apparatus for forming horse shoes comprising a hydraulic press having a ram and a cylinder, means to operate said press, a horse shoe former securable to the outer end of the ram or cylinder of the press, the former to engage in use with at least one blank of a length of elongate metal to be formed into a horse shoe, an anvil of which comprises two parts longitudinally spaced apart by a limit block of length equal to a distance determined by the breadth of the plates, the parts being mounted in sliding engagement on a block for movement towards or away from each other and made fast in a selected position by a limit block and by two-length adjustable screws the, or each, blank is deformed into a substantial U-shape by extension of said ram, and means on each side of, and on movement toward, said anvil to cause the outer ends of the, or each, deformed blank to be bent around said former, the forming having at least one plate with a periphery over its forming peripheral surface to complementarily engage the face on a respective blank to locate and correctly position said blank relative thereto and to the anvil.

5. Apparatus according to claim 4, wherein the limit block bears against the inner lateral sides of the parts and the screws bear one on each of the outer lateral sides of the parts.

6. Apparatus as claimed in claim 5, wherein the parts of the anvil each comprise two cheeks spaced apart the width of the former and between them carrying a low friction rotatable roller, the rollers of the parts being symmetrical about a vertical mid-way line of the distance between the parts.

7. A method of making a pair of left and right horse shoes simultaneously from fullered horse shoe iron bar blanks each having a sloped back shaped face, comprising placing the blanks bottom face-to-bottom face on a hydraulic press having a ram and a cylinder, a horse shoe former securable to the outer end of the ram or cylinder of the press, an anvil and bending means positioned on each side of the anvil;

operating the press to deform the blanks wherein the former engages the blanks forcing the blanks against the anvil into a substantial U-shape and bending the outer ends of the deformed blanks around said former by bending means positioned on each side of the anvil, the former having two similarly shaped plates, each plate having an angled periphery over its forming peripheral surface, the plates being arranged together in mirror image fashion to form a V-shaped cross section between the angled peripheries thereof engaging the inverted V-shape formed by the sloped back faces of the blanks to locate and correctly position said blanks relative to the former and to the anvil, forming in one operation a left and right horse shoe.

* * * * *